US012613064B2

(12) United States Patent
Berra et al.

(10) Patent No.: US 12,613,064 B2
(45) Date of Patent: Apr. 28, 2026

(54) POWER GENERATION PROCESS UTILIZING FUEL, LIQUID AIR AND/OR OXYGEN WITH ZERO $CO_2$ EMISSIONS

(71) Applicant: SAIPEM S.P.A., Milan (IT)

(72) Inventors: Matteo Berra, Milan (IT); Lorenzo Bruno, Milan (IT)

(73) Assignee: Saipem S.P.A., Milan (IT)

( * ) Notice: Subject to any disclaimer, the term of this patent is extended or adjusted under 35 U.S.C. 154(b) by 344 days.

(21) Appl. No.: 18/247,347

(22) PCT Filed: Sep. 30, 2021

(86) PCT No.: PCT/IB2021/058986

§ 371 (c)(1),
(2) Date: Mar. 30, 2023

(87) PCT Pub. No.: WO2022/070125

PCT Pub. Date: Apr. 7, 2022

(65) Prior Publication Data

US 2023/0417482 A1 Dec. 28, 2023

(30) Foreign Application Priority Data

Oct. 1, 2020 (IT) ..... 102020000023140

(51) Int. Cl.

| | |
|---|---|
| ***F25J 1/00*** | (2006.01) |
| ***F25J 1/02*** | (2006.01) |
| ***F25J 3/04*** | (2006.01) |

(52) U.S. Cl.

CPC ..... *F25J 1/0027* (2013.01); *F25J 1/0012* (2013.01); *F25J 1/0234* (2013.01); *F25J 1/0251* (2013.01); *F25J 1/0278* (2013.01); *F25J 3/04533* (2013.01); *F25J 3/04612* (2013.01); *F25J 3/04987* (2013.01); *F23C 2202/00* (2013.01); *F25J 2210/40* (2013.01); *F25J 2210/42* (2013.01); *F25J 2210/50* (2013.01); *F25J 2220/82* (2013.01); *F25J 2230/30* (2013.01); *F25J 2240/82* (2013.01);

(Continued)

(58) Field of Classification Search

CPC ..... F25J 1/0027; F25J 1/0204; F25J 2210/70; F25J 2240/82; F02C 3/20

See application file for complete search history.

(56) References Cited

U.S. PATENT DOCUMENTS

| | | | |
|---|---|---|---|
| 4,942,734 | A | 7/1990 | Markbreiter et al. |
| 5,664,411 | A | 9/1997 | Shao |

(Continued)

FOREIGN PATENT DOCUMENTS

| | | | |
|---|---|---|---|
| DE | 19728151 | A1 | 1/1999 |
| JP | H05187764 | A | 7/1993 |

(Continued)

OTHER PUBLICATIONS

International Search Report for International Patent Application No. PCT/IB2021/058986, mailed Jan. 21, 2022.

*Primary Examiner* — Brian M King
(74) *Attorney, Agent, or Firm* — Armstrong Teasdale LLP

(57) ABSTRACT

A system that integrates a power production system and an energy storage system represented by gas liquefaction systems is provided.

20 Claims, 10 Drawing Sheets

(52) U.S. Cl.
CPC ..... *F25J 2240/90* (2013.01); *F25J 2250/40* (2013.01); *F25J 2260/80* (2013.01)

(56) References Cited

U.S. PATENT DOCUMENTS

| | | | | |
|---|---|---|---|---|
| 2013/0111948 | A1* | 5/2013 | Higginbotham | F25J 3/04563 62/617 |
| 2015/0345859 | A1* | 12/2015 | Hashizume | F25J 3/04309 62/606 |
| 2016/0003527 | A1* | 1/2016 | Dean | F25J 1/005 62/614 |
| 2018/0080379 | A1* | 3/2018 | Conlon | F25J 1/0045 |
| 2018/0221807 | A1* | 8/2018 | Sinatov | F25J 1/0242 |

FOREIGN PATENT DOCUMENTS

| | | | |
|---|---|---|---|
| JP | 2009203860 | A | 9/2009 |
| KR | 102048844 | B1 | 11/2019 |

* cited by examiner

POWER GENERATION PROCESS UTILIZING FUEL, LIQUID AIR AND/OR OXYGEN WITH ZERO $CO_2$ EMISSIONS

CROSS-REFERENCE TO RELATED APPLICATIONS

This application is a National Stage Application of International Patent Application No. PCT/IB2021/058986, having an International Filing Date of Sep. 30, 2021, which claims priority to Italian Application No. 102020000023140, filed Oct. 1, 2020, the entire contents of each of which are hereby incorporated by reference herein.

TECHNICAL FIELD OF THE INVENTION

The present invention is applied to the energy field, in particular it integrates power production technologies and storage technologies.

BACKGROUND ART

It is known that electrical energy production and network stability rely on a variety of sources and technologies, first and foremost including thermal fuel power plants of various nature, nuclear, hydroelectric, wind, solar power plants, etc.

Peculiar aspects of each of these sources are mainly:

- production flexibility, i.e., how much the energy output based on the demand can vary and with what inertia,
- the availability of the source needed to produce electrical energy over time,
- the environmental impact, in terms of pollutants being harmful to health and greenhouse gas emissions (mainly $CO_2$).

Each of the aspects mentioned above corresponds to a constraint in the possibility of exploiting the energy source at issue; indeed:

- the energy demand is not constant over time, therefore the power plants must have the necessary flexibility to either increase or decrease the production based on the energy demand,
- the supply of energy from the source at issue may be more or less difficult, either for market issues or for geopolitical reasons or inherent in the nature of the source itself,
- the environmental impact limits its diffusion in percentage terms in the energy mix.

Based on these three aspects, the energy sources and the related exploitation technologies can be classified into:

- either rigid or flexible, where rigid technologies are typically large thermal power plants, whether of the combustible fuel or nuclear type, which encounter major difficulties in load variation, especially if it is required abruptly. Conversely, small turbogas power plants are flexible and, even more so are:
- the hydroelectric power plants,
- the continuous or intermittent power plants, where thermo-electric and hydroelectric power plants are examples of continuity, whilst solar and wind power plants are discontinuous,
- high or low emissions power plants, where combustion power plants are examples of high-emission power plants, as opposed to solar and wind power plants, which have virtually no emissions.

The rigidity and discontinuity of the energy sources are responsible for a misalignment between supply and demand and the consequent instability of the electrical power network, overloaded with energy which is impossible to be utilized by a small demand at certain times as opposed to periods of increased demand in which the electrical power network is not sufficiently supplied.

The issue of emissions, on the other hand, is increasingly driving the replacement of thermo-electric combustion technologies with sources having a lower environmental impact, mainly solar and wind, which however aggravate the problem of instability of the electrical power network because of their discontinuity.

Nowadays, the strategy to make the network stable consists of covering the demand peaks by means of hydroelectric and turbogas power plants which, by virtue of higher flexibility and less inertia in load variations, are particularly suitable for this purpose.

However, hydroelectric technology is mature and little space remains for its further diffusion, while turbogas power plants are responsible for the emission of large amounts of greenhouse gases.

Research has so far followed separate tracks, studying storage systems for solar and wind energy on the one hand and $CO_2$ sequestration systems for thermal fuel power plants on the other.

One of the most promising storage technologies is the production of liquid air from the excess of electrical energy, to then obtain power therefrom during demand peaks.

This technology is called LAES, standing for Liquid Air Energy Storage, and is shown in FIGS. 1A and 1B.

During storage, a LAES plant exploits the energy from renewable sources to produce liquid air, while in use it obtains power from the previously stored liquid air.

The energy can be conveniently recovered from the liquid air either through the use of a thermal machine operating between the ambient temperature and the evaporation temperature of the liquid air, which is used as a thermal sink, or through the following process (FIG. 1A):

1) the liquid air is pumped at high pressure,
2) it is heated by heat exchange with a return air current,
3) it undergoes a final heating to a temperature close to ambient temperature,
4) it undergoes an expansion up to super-critical pressure through a power-producing machine,
5) part of the expanded air is sent to the exchanger mentioned under 2) above and re-liquefied,
6) the remaining part of the air undergoes further expansion, through a power generating machine, to low pressure, and before being released into the atmosphere, gives its frigories in favor of the recycling current,
7) the current liquefied under 5) is laminated to the storage pressure: one part will evaporate and be released into the atmosphere after recovering the frigories, while the other part will remain stored.

The recent technologies in the area of carbon dioxide sequestration are based on combustion in an artificial atmosphere, mainly composed of carbon dioxide and oxygen, which for this reason is referred to as oxy-combustion.

In order to accomplish the oxy-combustion, oxygen from the atmosphere must be separated from nitrogen by means of a very energy-intensive process known in the art.

Known energy production systems by means of oxy-combustion are the Graz cycle and the Allam cycle.

The operation of an oxy-combustion turbogas power plant according to the Graz cycle is diagrammatically shown in FIG. 2, and can be described through the following steps:

1) burning a fuel in an appropriate combustor in an atmosphere of $CO_2$, $H_2O$, and $O_2$ at high pressure, with the conversion of the fuel and oxygen to carbon dioxide and water,
2) expanding the combustion gases in a machine which produces power and reduces the temperature of the combustion gases,
3) recovering heat from the exhaust fumes by means of a Rankine steam cycle,
4) further expanding the fumes in a power-producing machine,
5) condensing the water vapor from the fumes expanded in the preceding step,
6) re-compressing the exhaust fumes, composed of $CO_2$ and water, through a sequence of compression stages; at the appropriate pressure, the $CO_2$ produced in the combustion is tapped and sent to the sequestration operations; the remaining part of the exhaust fumes are further compressed until reaching an appropriate temperature, at which an inter-stage refrigeration is performed with the water being the motor fluid of the Rankine cycle,
7) finally compressing the remaining par of exhaust gases to combustor pressure,
8) recycling the exhaust gases to the combustor,
9) instead, the water condensed mentioned under 5) is pumped (the excess amount formed in the combustion is instead removed from the system) and pre-heated in the interstage refrigeration operation mentioned under 6),
10) then treating it according to known methods to make it suitable for steam generation,
11) then pumping it at high pressure and sending it to the heat recovery mentioned under 3), where it becomes steam,
12) expanding the steam in a turbine up to the pressure of the combustor mentioned under 1), and injected into the latter.

The production process of $O_2$ fed to the combustor is known in the art, and cryogenic air distillation is typically employed for large amounts.

Therefore, the Graz cycle comprises a Rankine steam cycle, which implies the release of large amounts of heat at low temperature, thus compromising the heat recovery efficiency.

A solution to this problem is offered by the Allam cycle, in which the elimination of the Rankine cycle is suggested.

As shown in the diagram in FIG. 3:

1) burning a fuel in an appropriate combustor in an atmosphere of $CO_2$, $H_2O$, and $O_2$ at high pressure, with the conversion of the fuel and oxygen to carbon dioxide and water,
2) expanding the combustion gases in a machine which produces power and reduces the temperature of the combustion gases,
3) recovering heat from the exhaust fumes by means of the carbon dioxide recirculated to the combustor mentioned under 1),
4) further cooling the exhaust fumes and separating the condensed water,
5) re-compressing the exhaust fumes, mainly consisting of $CO_2$ to supercritical pressure,
6) cooling the fumes mentioned under 5) to sub-critical temperature,
7) pumping the liquid carbon dioxide to the appropriate pressure to return it to the combustor mentioned under 1),
(8) heating the $CO_2$ mentioned under 7) in the thermal recovery operation mentioned under 3).

The process of producing $O_2$ fed to the combustor belongs to the prior art, and cryogenic air distillation is typically employed for large amounts.

The oxy-combustion process is configured as an energy production system, possibly to be used to cover network demand peaks but is not an energy storage system per se.

Furthermore, this system also greatly suffers from the operations of separating oxygen from nitrogen and liquefying a portion of the $CO_2$, which results in an efficiency reduction from a theoretical 58% of a combined cycle, without $CO_2$ sequestration, to 35%.

Furthermore, the Rankine steam cycle for recovering heat from exhaust fumes is limited in efficiency by the significant condensation heat of water, as noted by the inventors of the Allam cycle, in addition to requiring a long series of operations to condition the water and dispose of the additives injected into the latter.

Furthermore, the $CO_2$ obtained from the process is either gaseous, as in the case of the Graz cycle, or liquid, only at high pressure, therefore an additional treatment is needed for it to be stored.

LAES technology requires a significant energy expenditure for the production of liquid air estimated at 0.45 kwh/kg, which strongly limits the amount of recoverable energy: the efficiency of a LAES system demonstrated to date is about 15%.

Prior art document DE 197 28 151 A1 describes an oxy-combustion cycle, the process of which does not employ liquid air or oxygen-depleted air as a working fluid for the condensation of the carbon dioxide obtained from the combustion.

Prior art document U.S. Pat. No. 5,664,411 A describes a process of gasifying a gas fuel starting from coal and integrating the reactor with a common air-operated gas turbine, further employing a Rankine steam cycle.

SUMMARY OF THE INVENTION

The inventors of the present patent application have surprisingly found that oxy-combustion technologies can be synergistically integrated with liquid air energy storage (LAES) technologies, by means of a highly efficient process, which allows obviating the problem of fluctuations in the demand and production of electrical energy, and thus providing a stabilizing effect of the electrical power network, further promoting the use of renewable energy.

OBJECT OF THE INVENTION

The present invention relates to a process for producing power and liquefying one or more gases, which employs a first and second working fluid.

In a first embodiment, said liquefaction comprises a step of direct heat exchange between said gas and said second working fluid.

In a second embodiment, said liquefaction comprises a step of indirect heat exchange between said gas and said second working fluid.

According to a first aspect of the invention, the first working fluid is liquid air and the second heat exchange fluid is oxygen.

In a second aspect of the invention, the first heat exchange fluid is oxygen-depleted air and the second heat exchange fluid is oxygen.

Variants of the described embodiments are further objects of the invention.

DETAILED DESCRIPTION OF THE INVENTION

Figure 1A:
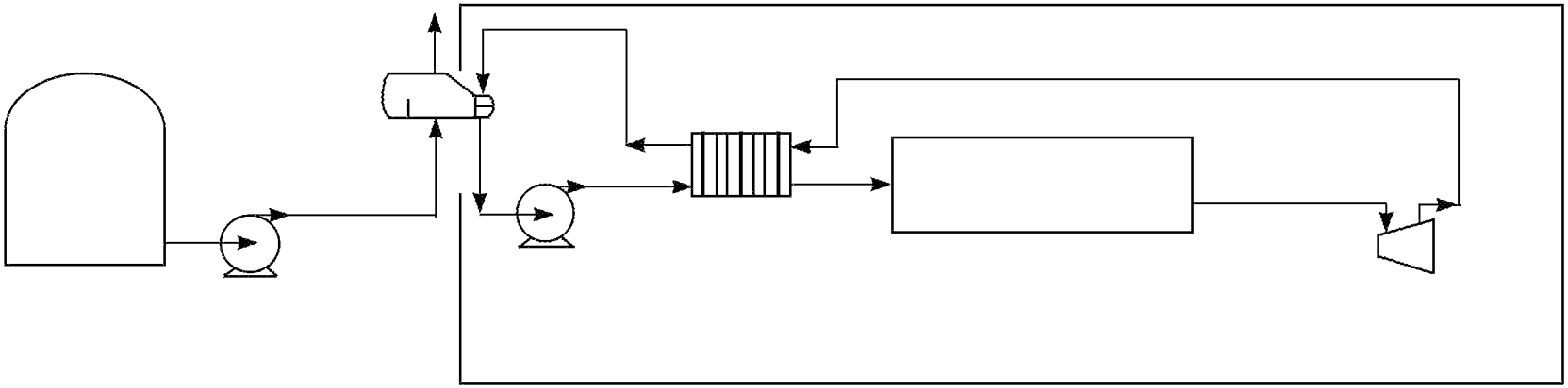
FIGS. 1A and 1B show two examples of LAES systems.
Figure 1B:
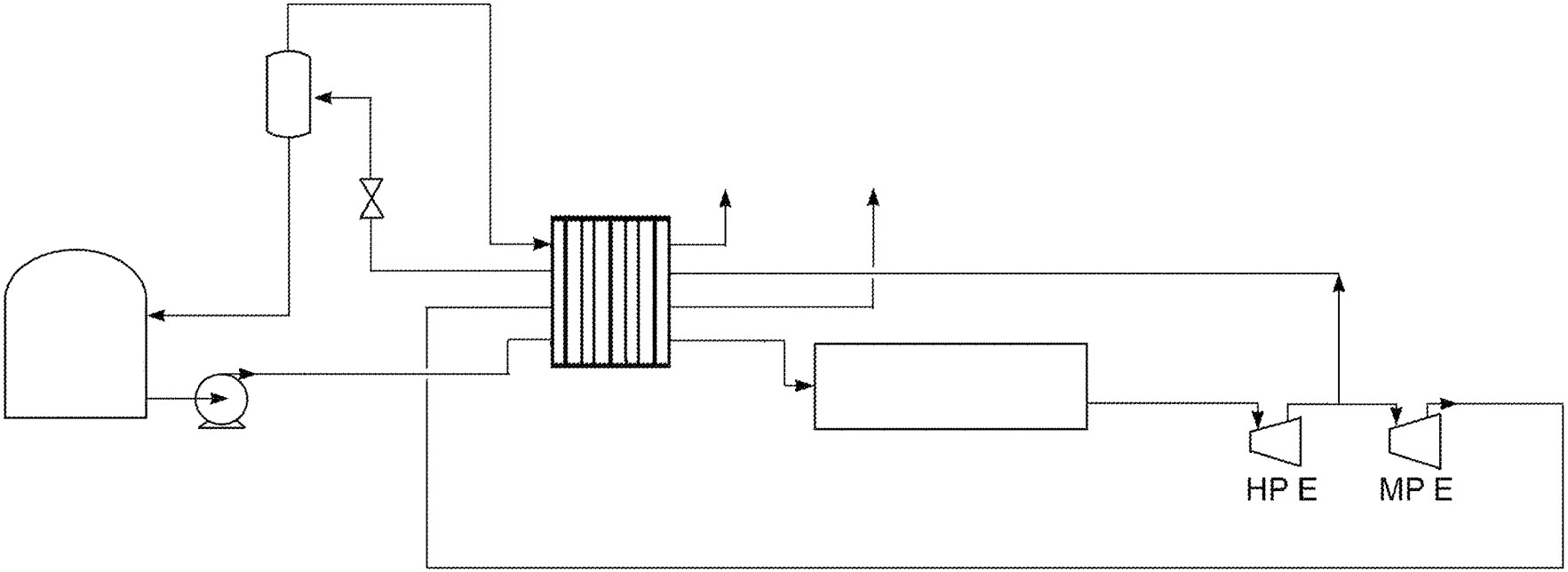
Figure 2:
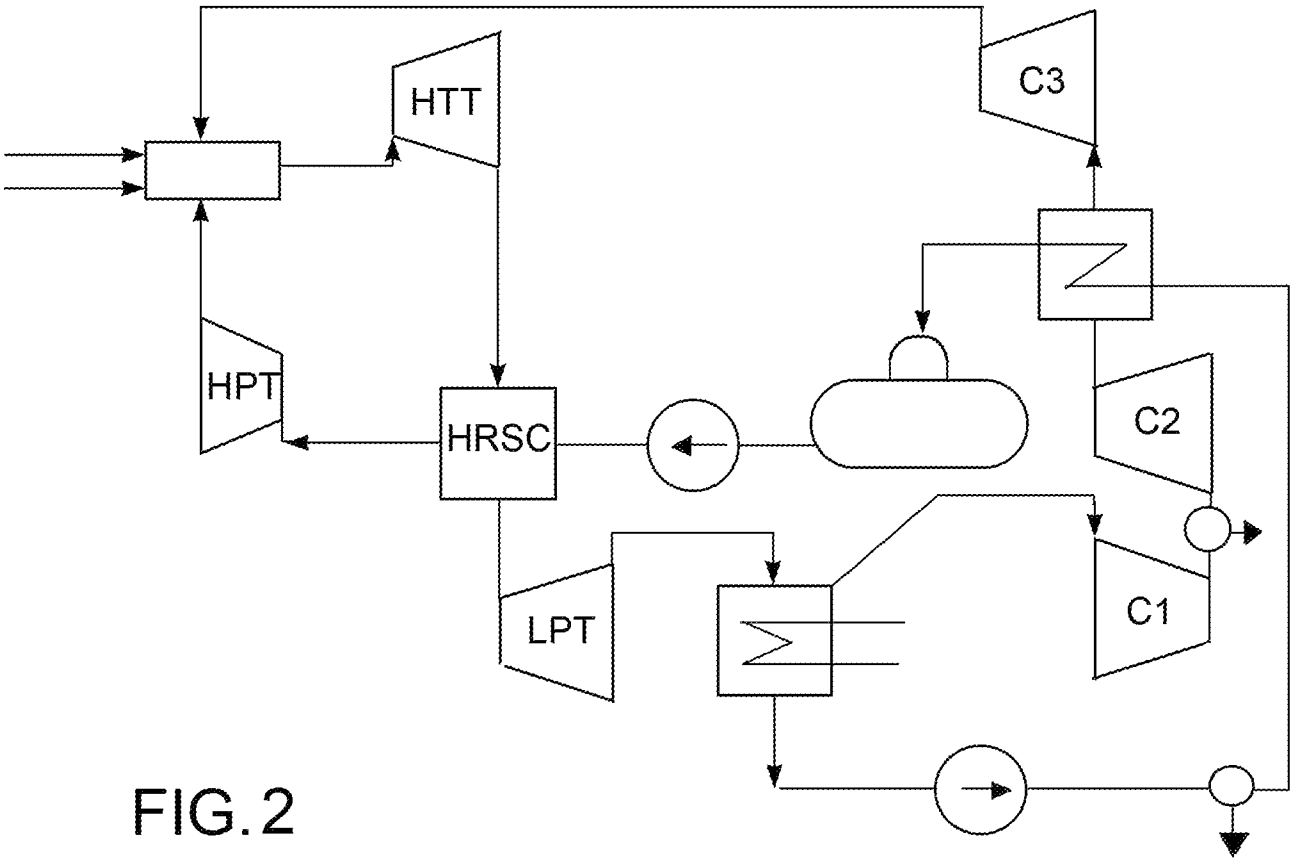
FIG. 2 shows an example diagram of a Graz cycle.
Figure 3:
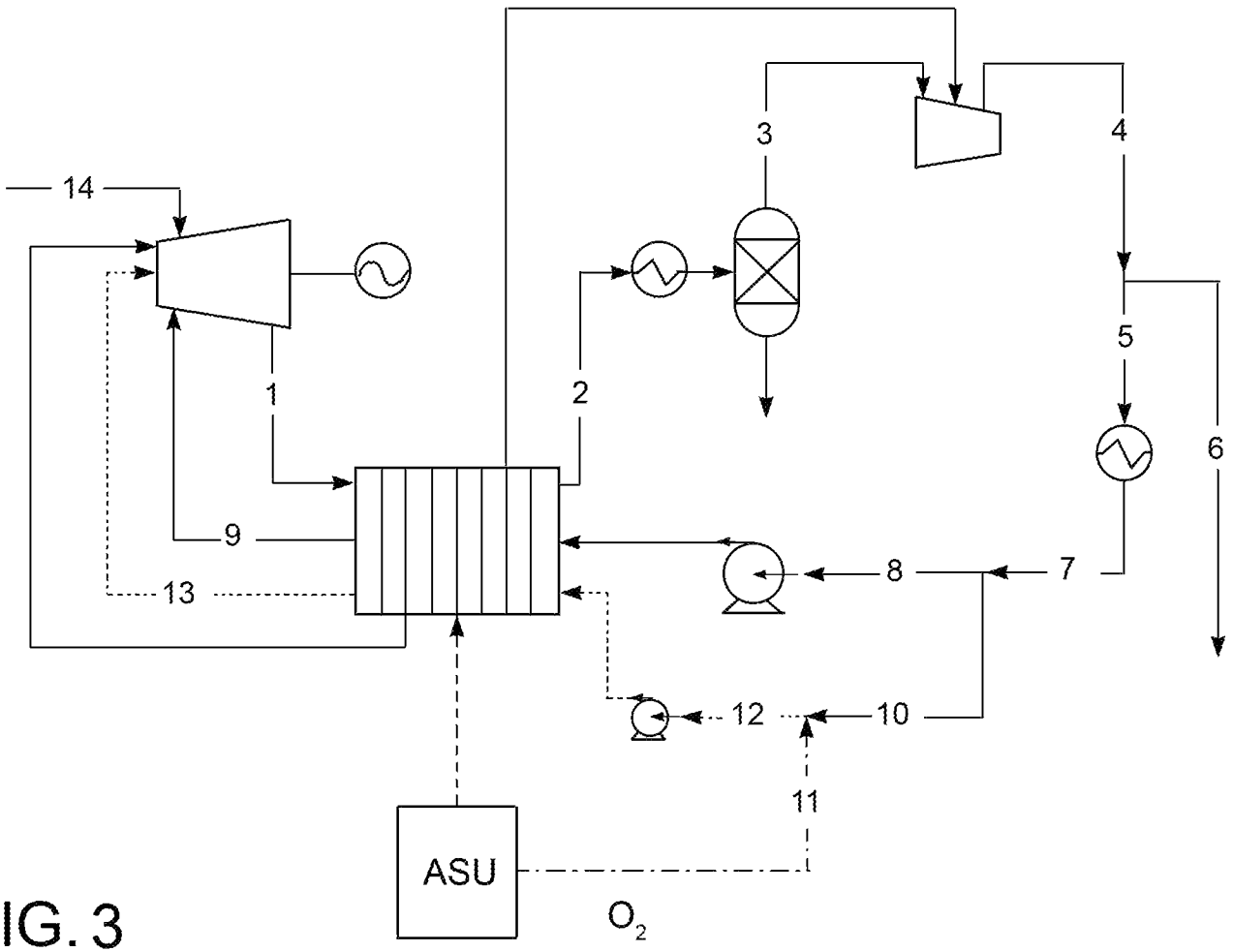
FIG. 3 shows an example diagram of an Allam cycle.

According to a first object of the invention, a process for producing power and liquefying a gas is described.

In particular, such a method comprises the steps of:

1) producing, in a combustor COMB, an exhaust gas 1 comprising water vapor and $CO_2$,
2) expanding said exhaust gas 1 in a first turbine EX1 with power production, thus obtaining an expanded exhaust gas 2,
3) cooling the expanded exhaust gas 2 thus obtained in a heat recovery unit WHRU, thus obtaining a partial condensation flow 3 of the water vapor (or cooled exhaust gas),
4) separating, in a first separator S1, the condensed water vapor 5 and a partially dehydrated exhaust gas 4,
5) compressing said partially dehydrated exhaust gas 4 in a first compressor C1, thus obtaining a compressed exhaust gas 6,
6) separating a first portion 19 of said compressed exhaust gas 6 and further compressing it in a second compressor C2,
7) returning the further compressed exhaust gas thus obtained to said combustor COMB,
8) cooling a second portion of the compressed exhaust gas 7 in a first exchanger TE1, thus obtaining a second cooled portion 8,
9) separating, in a second separator S2, a flow of condensed water vapor 9 and a further dehydrated exhaust gas 10,
10) further dehydrating said further dehydrated exhaust gas 10 thus obtaining an even further dehydrated exhaust gas 11,
11) liquefying the $CO_2$ contained in said even further dehydrated exhaust gas 11 in a liquefaction unit LU and obtaining a flow 13 of liquid $CO_2$.

For the purposes of the present invention, step 1) can be achieved by high-pressure combustion of a fuel F in an atmosphere of $CO_2$ and $O_2$.

In particular, the $CO_2$ and $O_2$ flows sent to the combustor are separated from each other, and more in particular come from mutually different steps, as will be described below.

In step 2), the generated power can be converted into electrical and/or mechanical energy according to techniques known in the field.

It is apparent that the expanded exhaust gas 2 produced in step 2) is a carbon dioxide-rich gas.

For the purposes of the present invention, in step 3), inside the heat recovery unit WHRU, the cooling of the expanded exhaust gas 2 is obtained by virtue of the heat exchange with a first working fluid.

Such a working fluid is thus heated.

More in particular, the cooling may be achieved by means of one or a plurality of successive heat exchange steps with said first working fluid.

According to a preferred aspect of the invention, after each heat exchange step, said first working fluid may be expanded in a respective step of expansion.

Therefore, according to the present invention, each step of heat exchange may occur with said first working fluid in unexpanded form or in expanded form after one or more steps of respective and preceding heating.

For the purposes of the present invention, in particular, said steps of heat exchange are first implemented with said first working fluid in an expanded form after one or more steps of expansion, and then with said first working fluid in a less expanded form, and finally with said first working fluid in an unexpanded form; this is irrespective of the number of steps of heat exchange (heating) and possible expansion.

Since said first working fluid is more heated after each step of heat exchange, successive steps of heat exchange (cooling) of the exhaust gas take place with a flow of the first working fluid which has not yet been heated, as well as possibly expanded; therefore, the exhaust gas flow gradually encounters a flow of the first working fluid which is less heated (not yet heated) and less expanded (not yet expanded).

In an embodiment of the invention, said step 3) can comprise two heat exchanges implemented with a flow of the first working fluid expanded after a step of expansion and a flow of the unexpanded first working fluid, respectively.

Thus, in particular, said step 3) can comprise:

- a first heat exchange 3a) between said expanded exhaust gas 2 and a heated flow 33 previously expanded in a second expander EX2 of said first working fluid, thus obtaining a partially cooled expanded exhaust gas 2' and a first further heated working fluid 34,
- a second heat exchange 3b) between said partially cooled expanded exhaust gas 2' and a not yet unexpanded flow of said first working 31.

For the purposes of the present invention, the flow of the first heated and expanded working fluid 33 involved in step 3a) is obtained from step 3b), as described above.

After step 3), the flow of the first further heated working fluid 34 is expanded again in a third expander EX3 and the further heated and expanded flow 35 thus obtained is released into the atmosphere, being composed of air or mixtures of the components thereof.

It is worth noting that, in particular, the flow of the first working fluid entering step 3b) is a high-pressure flow 31 obtained by pumping, with a first pump P1, a flow of the first working fluid 30, and that from step 3b) the flow of the first heated working fluid 32 is obtained, which is expanded at medium pressure (partially expanded) in the second expander EX2, thus obtaining the heated flow 33.

As disclosed above, for the purposes of the present invention, the number of heat exchanges inside the heat recovery unit WHRU between the expanded exhaust gas 2 and the first working fluid may also be one or more than two, as needed.

For the purposes of the present invention, the heat recovery unit WHRU preferably is an exchanger.

According to a first embodiment of the invention, said first working fluid is liquid air.

Anticipating a second embodiment of the invention, described below, said first working fluid is oxygen-depleted air.

Said first working fluid is produced in earlier steps according to methods known in the art, e.g. by known air liquefaction or separation techniques in an air separation unit (ASU) and stored in an appropriate tank ST1, possibly at a pressure above the atmospheric pressure.

Therefore, a flow which is even richer in $CO_2$ is obtained with the separation of some of the condensed water vapor in step 4).

With respect to step 5), this preferably includes the compression to be conducted up to an appropriate pressure and above the triple point of $CO_2$; in a preferred aspect, such a compression is up to 15 barg and more preferably about 6-10 barg.

In an aspect of the invention, the re-compression step 6) is conducted by compressing the first portion of exhaust gas 19 in the second compressor C2 to obtain a further compressed exhaust gas flow 20 at the same pressure as the combustion chamber COMB.

Therefore, for the purposes of the present invention, a $CO_2$-rich flow, such as that represented by the further compressed exhaust gas flow 20, is returned to the combustor COMB.

In an aspect of the invention, step 10) is conducted in a dehydration unit (DHU in FIG. 4) until a water content of less than 500 ppm and preferably less than 50 ppm is obtained.

Therefore, for the purposes of the present invention, the $CO_2$ is liquefied and separated from the initial flow of the expanded exhaust gas 2.

$CO_2$ is then stored for other purposes.

For the purposes of the present invention, the step 11) of liquefying the $CO_2$ contained in said even more dehydrated exhaust gas 11 comprises the use of a second working fluid.

In particular, said step 11) comprises a heat exchange between said even more dehydrated exhaust gas 11 and said second working fluid 41, thus obtaining a flow of the second partially heated working fluid 42.

According to a first embodiment of the invention, said heat exchange is direct.

Anticipating a second embodiment of the invention, described below, said heat exchange is indirect, instead.

According to an embodiment of the invention, said flow of the second partially heated working fluid 42 can be employed in step 3) described above in a further step of heat exchange with the expanded exhaust gas 2 in the heat recovery unit WHRU, thus obtaining a further heated second working fluid flow 43, which is in gaseous form.

After said further heat exchange, the flow of the second working fluid 43, in gaseous form, is then sent to the combustor COMB of step 1).

For the purposes of the present invention, the second working fluid is liquid oxygen.

Thus, as described above, the flow of the second working fluid, e.g., oxygen, 43 sent to the combustor COMB is a different flow from that of the $CO_2$ sent to the same combustor.

In particular, said second working fluid is high-purity oxygen, meaning a purity preferably higher than 80% and more preferably higher than 95%.

For the purposes of the present invention, said second working fluid is produced in a preceding step according to methods known in the art, e.g., by known air liquefaction or separation techniques in an air separation unit (ASU) and stored in an appropriate tank ST2, possibly at a pressure above atmospheric pressure.

As described above, in a first embodiment, the liquefaction of $CO_2$ in step 11) is conducted by direct heat exchange between said even more dehydrated exhaust gas 11 and a flow of the second working fluid 41, i.e., liquid oxygen.

In particular, for the purposes of the present invention, such a step 11) comprises the sub-steps of:

11a) cooling said even more dehydrated exhaust gas 11 in a second exchanger LUTE, thus obtaining a flow 12 mainly composed of $CO_2$, 11b) separating a flow of pure condensed $CO_2$ 13 from the bottom of a third separator S3 and a first $CO_2$-rich gaseous phase 14 from the head of said third bi-phase separator S3, 11c) compressing said first $CO_2$-rich gaseous phase 14 into a third compressor C3, thus obtaining a compressed gaseous flow 15, which is then cooled in the second exchanger LUTE by heat exchange with the flow of the second working fluid 41 of step 11a), thus obtaining a further cooled flow 16, 11d) separating, in a fourth separator S4, an uncondensed gas flow 17 from the head, which is released into the atmosphere, and a second $CO_2$-rich liquid phase 18 from the bottom, which is combined, after lamination by means of the lamination valve V1, with the flow 12 mainly composed of $CO_2$ obtained in step 11a) and then sent to the third separator S3 for step 11b).

In an aspect of the invention, the $CO_2$ liquefaction step 11a) includes cooling it to a temperature between the triple point of $CO_2$ and −40° C.

In an aspect of the invention, steps 11b), 11c) and 11d) can be repeated multiple times, if required and justified by the need to achieve an effective $CO_2$ separation and an acceptable plant complexity.

In particular, step 11a) and step 11c) are preferably conducted in the same second exchanger LUTE.

In step 11d), the gas flow 17 released into the atmosphere mainly consists of oxygen, argon, nitrogen, and non-separated $CO_2$.

Thus, a liquid $CO_2$ flow is obtained from step 11), which for the purposes of the present patent application can also be referred to as pure $CO_2$; indeed, such a flow comprises only traces of other components, such as oxygen, nitrogen, and argon.

As described above, in an alternative embodiment, the $CO_2$ liquefaction of step 11) is a step 11') conducted by indirect heat exchange between said even more dehydrated exhaust gas 11 and a high-pressure pumped flow 41 of said second working fluid, preferably represented by liquid oxygen.

Indeed, said heat exchange is mediated by a refrigerant vector fluid RF.

For the purposes of the present invention, said refrigerant vector fluid RF is chosen from the group comprising: CF4, argon, R32, R41, R125, etc.

In particular, said step 11') is conducted inside a liquefaction unit LU.

For purposes of the present invention, step 11') can comprise the sub-steps of:

11'0) obtaining, by cooling in second exchanger LUTE, a cooled flow of said refrigerant vector fluid 50 by heat exchange with a flow pumped at high pressure of said second working fluid 41, 11'a) cooling, in a refrigerant bath RB, the even more dehydrated exhaust gas flow 11 by heat exchange with a flow of said refrigerant vector fluid 50, thus obtaining a flow 12 mainly composed of $CO_2$ and an evaporated refrigerant vector fluid 51, 11'b) separating, in a third separator S3, a flow of pure $CO_2$ 13 from the bottom and a first gaseous phase 14 from the head of said third separator S3, 11'c) compressing said first gaseous phase 14 in a third compressor C3 thus obtaining a first compressed gaseous phase 15, then cooled in the same refrigerant bath RB by heat exchange with the flow of the refrigerant vector fluid 50, thus obtaining an evaporated refrigerant vector fluid 51 and a cooled mixed phase 16, 11'd) separating, in a fourth separator S4, an uncondensed gas flow 17 from the head, which is released into the atmosphere, and a second liquid phase 18 from the bottom of said fourth separator S4, which is combined, after lamination by means of the lamination valve V1, with the flow 12 mainly composed of $CO_2$ obtained from step 11'a) and then sent to the third separator S3 for step 11'b).

In an aspect of the invention, the $CO_2$ liquefaction step 11'a) includes cooling it to a temperature between the triple point of $CO_2$ and −40° C.

In an aspect of the invention, steps 11'b), 11'c) and 11'd) can be repeated multiple times, if required and justified by the need to achieve an effective $CO_2$ separation and an acceptable plant complexity.

In particular, step 11'a) and step 11'c) are conducted in the same refrigerant bath RB.

In step 11'd), the gas flow 17 released into the atmosphere mainly consists of oxygen, argon, nitrogen, and the non-separated $CO_2$.

As for the evaporated refrigerant vector flow 51 obtained after the heat exchange step 11a') with the even more dehydrated exhaust gas flow 11, this is subjected to compression in a fourth compressor C4, thus obtaining a compressed RF refrigerant vector flow 52 then cooled in step 11'0).

One or more variations can be made to the embodiments described above, which include the use of a refrigerant bath RB for liquefying $CO_2$ through a refrigerant vector fluid RF, as described below.

According to a first variant, a portion 31' of the first working fluid separated by a second valve V2, before being sent to the heat recovery unit WHRU, undergoes heating in the second heat exchanger LUTE by heat exchange with the compressed refrigerant vector flow 52.

In particular, a heated portion 31" is thus obtained which, before being sent to the heat recovery unit WHRU, is combined with the flow of the first working fluid 31.

Advantageously, in this manner it is possible to modulate the temperature of the first working fluid and thus the heat exchange in step 3); furthermore, it is possible to modulate the frigories available for the condensation of the $CO_2$ contained in the second portion of the exhaust gas, so as to condense the $CO_2$ not coming from the combustion but that possibly accompanies the fuel itself.

According to a second variant, after step 6) of further compression of the exhaust gas, a portion of said further compressed flow 20', before being returned to the combustor COMB, is subjected to a pre-heating step in the heat recovery unit (WHRU).

In particular, within the heat recovery unit WHRU, said portion of the further compressed flow 20' is subjected to heat exchange with the expanded exhaust gas flow 2 already cooled in the preceding step 3), thus obtaining a further heated portion 20'.

Advantageously, a saving of the fuel used in the oxy-combustion process is achieved by recovering a portion of the heat of the combustion fumes by virtue of said further heated portion 20", consisting of the same fumes but at a higher pressure.

Furthermore, the flow rate of the first working fluid to be used in such a heat recovery operation in the heat recovery unit WHRU is decreased, and this is advantageous because the energy spent to produce it in a liquid state is reduced.

Of course, the pre-heating of the recirculating current 20' also implies a lower net power obtainable from the oxy-combustion process, with the same systems being used, this mainly meaning the use of the same combustor and the same expander (turbine) of the combustion fumes; in any case, the choice of whether or not to pre-heat the recirculation current, and in what proportion, is a valid element of application flexibility.

An alternative embodiment of this layout consists in that some of the heat recovered in the heat recovery unit WHRU in step 3) is fed to a thermal machine which produces power and rejects heat with which the liquid air taken from storage can be pre-heated before receiving heat in the WHRU.

As described above, according to a first embodiment of the invention, the second working fluid is liquid oxygen, and more in particular high-pressure liquid oxygen.

In particular, such a second working fluid is oxygen with a purity preferably higher than 80% and more preferably higher than 95%.

Instead, as for the first working fluid, this can be liquid air, and in particular high-pressure liquid air.

For the purposes of the present invention, the liquid air is obtained from an air condensation unit, and the liquid oxygen is obtained from an air separation unit, according to techniques known in the field.

After the preparation, the first and second working fluids are stored in respective storages ST1 and ST2 and sent to heat exchanges after pumping at high pressure by respective first and second pumps P1,P2.

More in particular, the oxygen can be pumped at a slightly higher pressure than that of the combustor, while the liquid air is pumped at an even higher pressure.

According to a second embodiment, the second working fluid is liquid oxygen, and more in particular high-pressure liquid oxygen.

In particular, such a second working fluid is oxygen with a purity preferably higher than 80% and more preferably higher than 95%.

Instead, as for the first working fluid, this can be oxygen-depleted air in gaseous form.

According to a further embodiment, there is provided the use of a third working fluid preferably represented by liquid air, produced by known techniques and appropriately stored in a third storage ST3.

Figure 6:
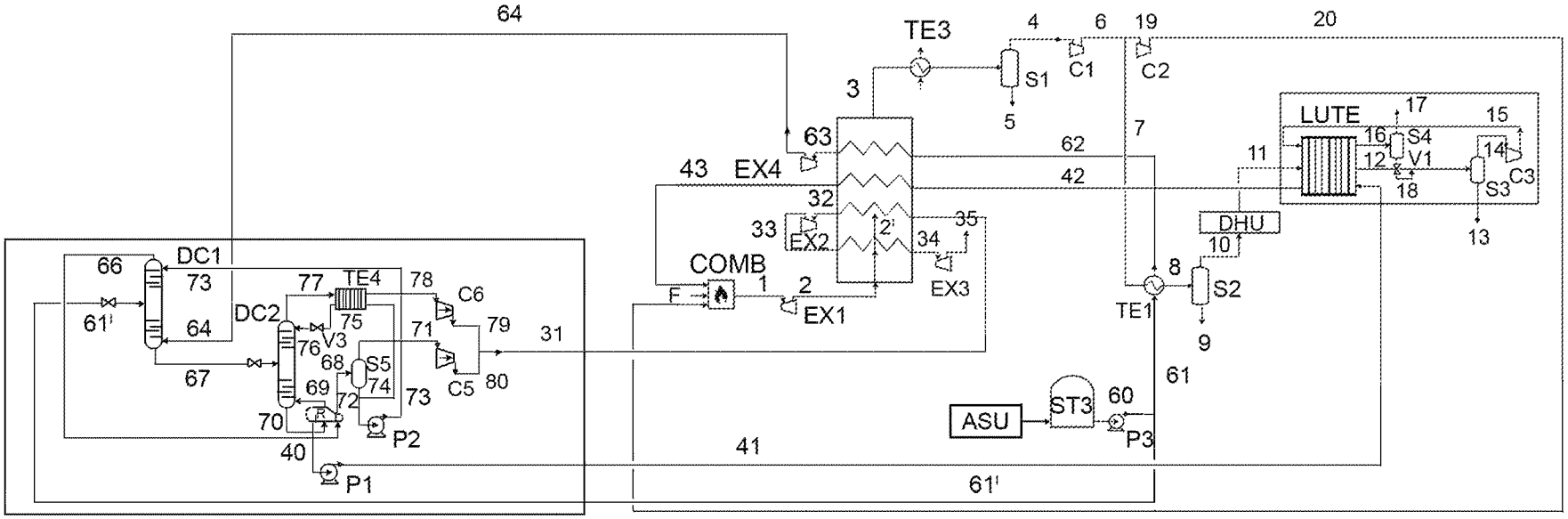
FIG. 6 shows a second embodiment of the invention.

In particular, reference is made to FIG. 6.

According to such an embodiment, a flow of the third working fluid 60, preferably liquid air, is pumped at high pressure by a third pump P3, thus obtaining a high-pressure flow 61, and is employed in step 8) described above for cooling the second portion of the flow 7 of compressed exhaust gas, thus obtaining a heated flow of the third working fluid 62.

Such a heated flow 62 of the third working fluid is then sent to the heat recovery unit WHRU to perform a further heat exchange with the expanded exhaust gas 2 previously cooled in step 3).

In a successive step, the heated flow of the third working fluid 63 thus obtained is expanded in a fourth expander EX4 with power production and then sent to an air separation unit (ASU).

For the purposes of the present patent application, a flow of the third heated and expanded working fluid 64 is thus obtained, which is recirculated at the inlet at the bottom of a first air distillation column DC1 of the air separation unit (ASU).

According to this embodiment, after step 3) and before step 4), the cooled exhaust gas flow 3 exiting the heat recovery unit WHRU may undergo further cooling in a third exchanger TE3.

According to this embodiment, a portion 61' of the third pumped working fluid, preferably liquid air, is sent to the inlet of a first distillation column DC1 of the air separation unit (ASU).

According to a possible variant of this embodiment (depicted n in FIG. 7B, for example), a second portion 61" of the third pumped working fluid flow is not sent to the pre-heating of step 8) but is sent to the second exchanger LUTE, thus obtaining a heated portion 61'" of the third working fluid, which is then combined with the pre-heated flow 62.

Advantageously, in this manner, it is possible to modulate the frigories available for the condensation of the $CO_2$ contained in the second portion of the exhaust fumes, so as to condense the $CO_2$ not coming from the combustion but possibly accompanying the fuel itself.

Figure 7A:
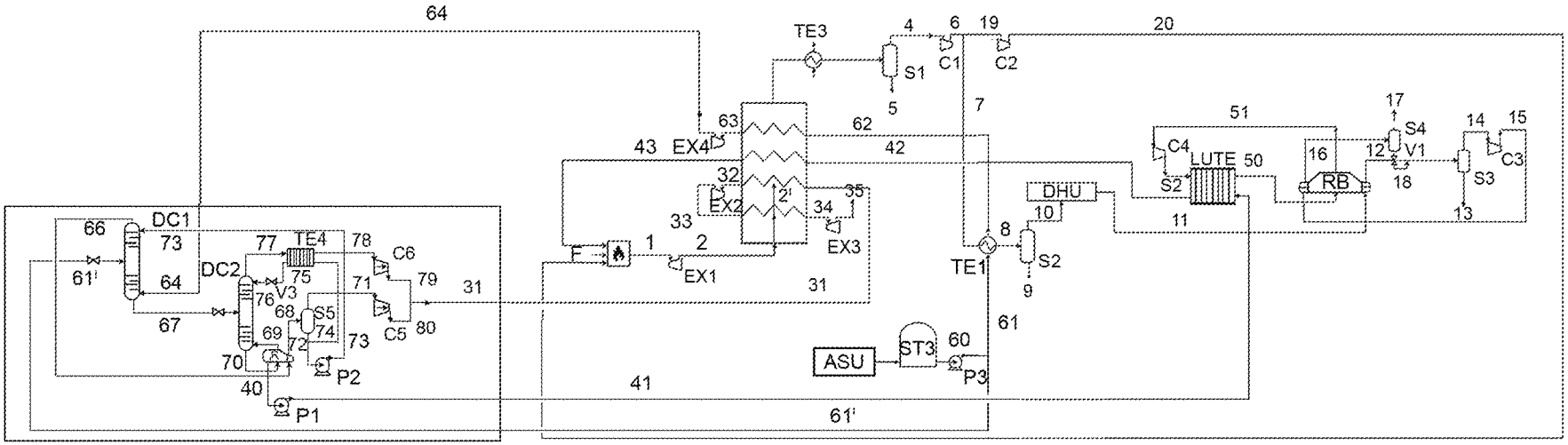
FIG. 7A shows a variant of the second embodiment of the invention, in which the condensation of $CO_2$ is achieved by means of a refrigerant bath.
Figure 7B:
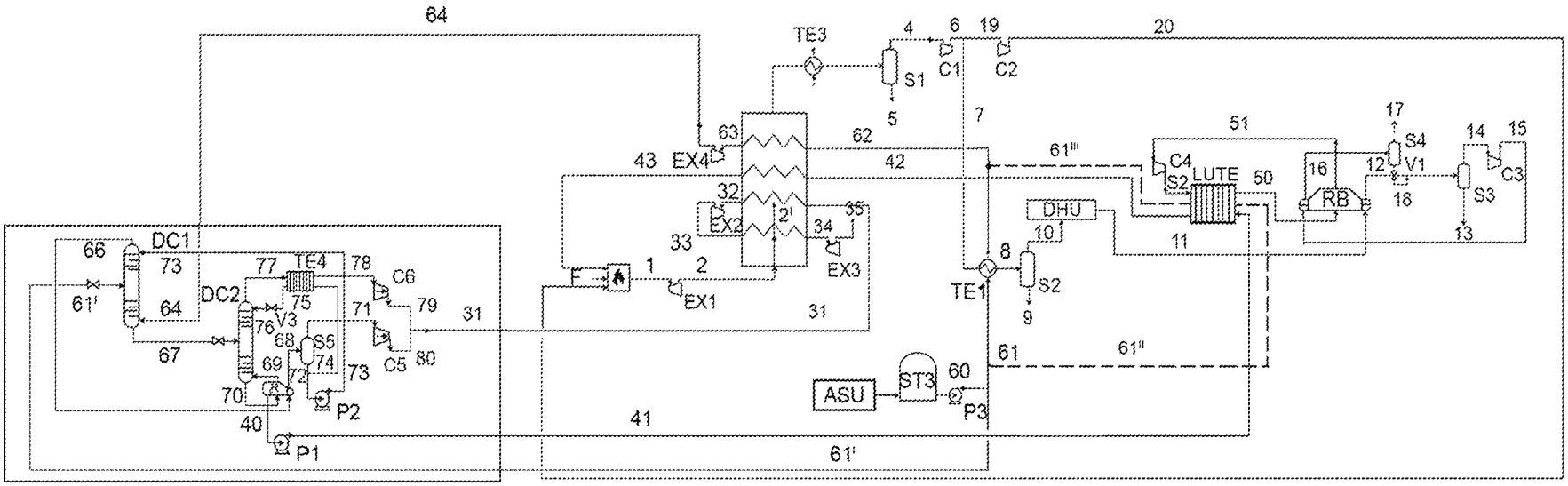
FIG. 7B shows a modification of this variant.

FIGS. 6, 7A, and 7B show an example of a possible configuration of an air separation unit (ASU) comprising an air distillation column DC1 as described above.

Other configurations will also be possible as known by a person skilled in the art.

An example of an air distillation system is shown in FIGS. 6, 7A, and 7B, for example.

In particular, said system comprises a first distillation column DC1 and a second distillation column DC2.

More in particular, the first distillation column DC1 is fed by a bottom flow 64 consisting of the flow of the third expanded working fluid obtained after the heat exchange step in the heat recovery unit WHRU.

The second distillation column DC2 is fed by the bottom flow 67 exiting the first distillation column DC1 and comprises a reboiler R to which the head flow 66 exiting the first distillation column DC1 is sent and the recirculation flow 69 of which is recirculated to the second distillation column DC2.

In particular, said head flow 66 of the first distillation column DC1 mainly consists of nitrogen, and to a lesser extent oxygen, while the bottom flow 67 is a flow mainly comprising oxygen (preferably, 30% to 50%).

By sending the head flow 66 of the first column DC1 to the reboiler R, the partial condensation 68 thereof is obtained, and the partially condensed flow thus obtained is sent to a fifth separator S5; after the separation of a gas phase 71 from the head of the fifth separator S5, a first portion of the liquid 72 separated from the bottom of said fifth separator S5 is pumped, thus obtaining a pumped flow 73 which is sent to the head of the first distillation column DC1.

Instead, the second portion of the separated liquid 74 is sent to the second distillation column DC2, after being cooled 75 in a fourth exchanger TE4 by heat exchange with the head flow 77 exiting the second column DC2 and lamination by a valve V3 at the pressure of the column 76 itself.

A liquid oxygen flow 40 is also obtained from the reboiler R, which is pumped at high pressure by the first pump P1 to form the second working fluid.

As for the separated gas flow at the head of the fifth separator S5, this is compressed at high pressure 80 in a fifth compressor C5 and combined with the head flow 77 exiting the second distillation column DC2 after heat exchange in the fourth exchanger TE4 78 and after high pressure compression 79 by a sixth compressor C6.

The flow 31 thus obtained from the combination of the high pressure flows 79 and 80 is the first working fluid.

Preferably, the first distillation column DC1 operates at high pressure, and in particular at a pressure between 1 barg and the critical air pressure, and preferably between 15 and 30 barg.

Preferably, the second DC2 distillation column is at low pressure.

The above-described embodiment of the invention comprising the use of an air separation unit by means of air distillation has the advantage that there is no need for separate storage of liquid oxygen, which circumstance is to be preferred in offshore applications, for example.

Examples of embodiments according to the above description are diagrammatically depicted in the figures.

Figure 4:
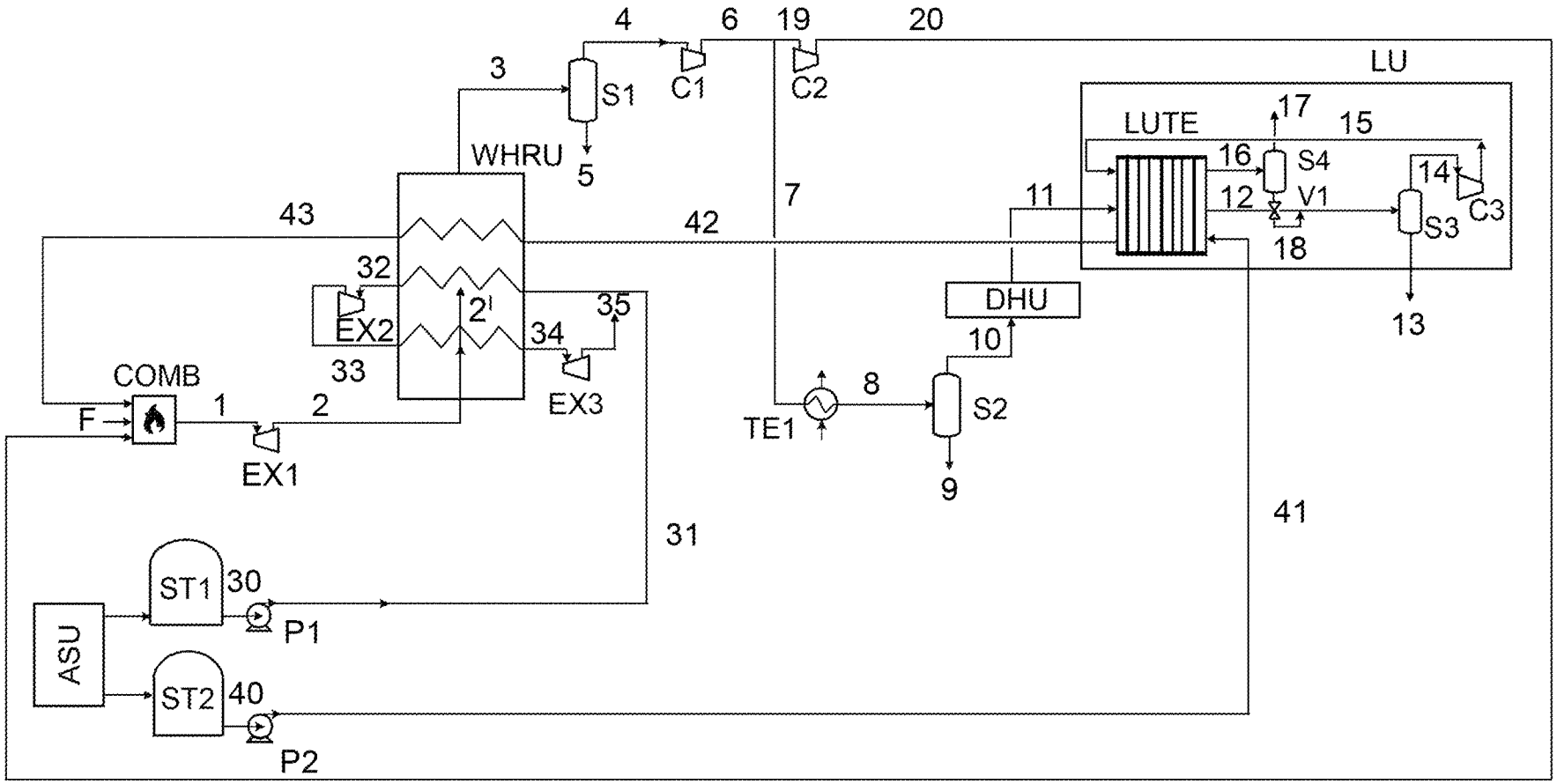
FIG. 4 shows a first embodiment of the invention.

In particular, the diagram in FIG. 4 includes the use of liquid air as the first working fluid, while the $CO_2$ liquefaction unit comprises an exchanger, in which a direct exchange with the second working fluid is conducted.

Figure 5A:
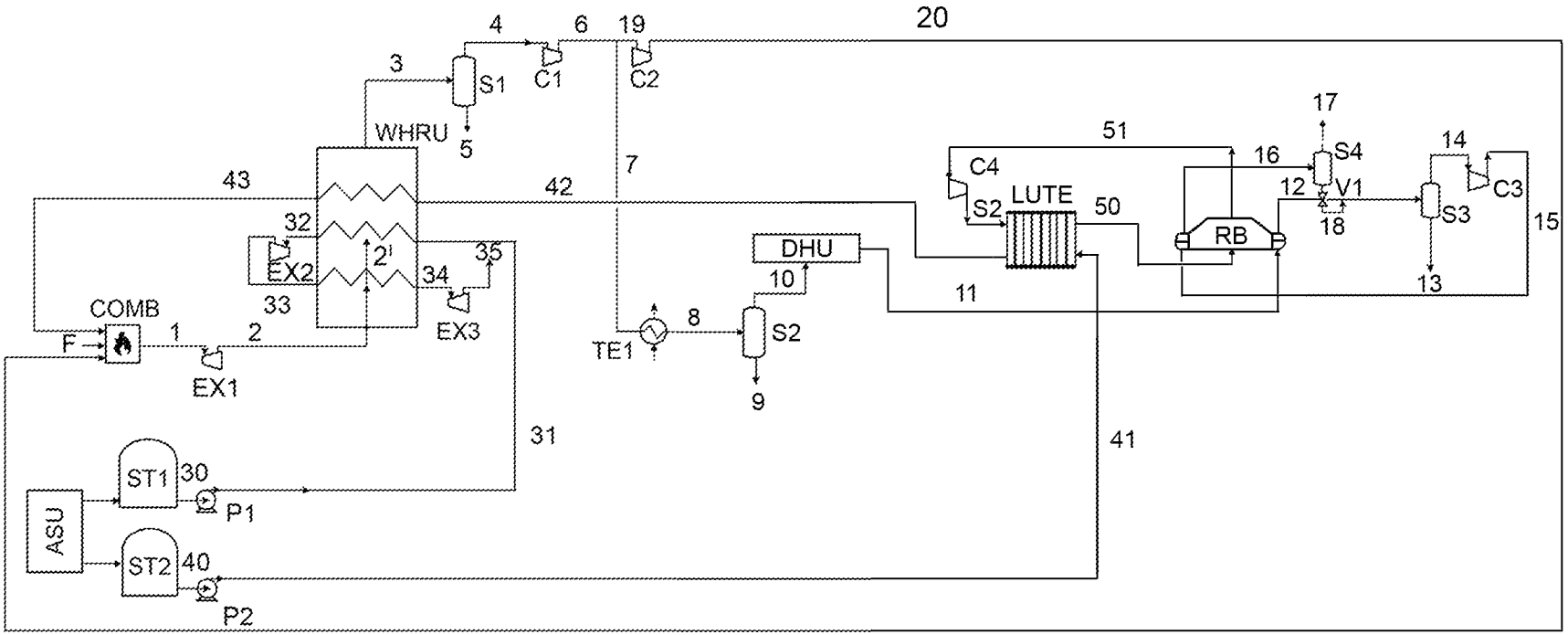
FIG. 5A shows a variant of the first embodiment of the invention, in which the condensation of $CO_2$ is achieved by means of a refrigerant bath.

The diagram in FIG. 5A includes the use of liquid air as the first working fluid, while the $CO_2$ liquefaction unit comprises an exchanger, in which an indirect exchange with the second working fluid mediated by a refrigerant vector fluid is conducted.

Figure 5B:
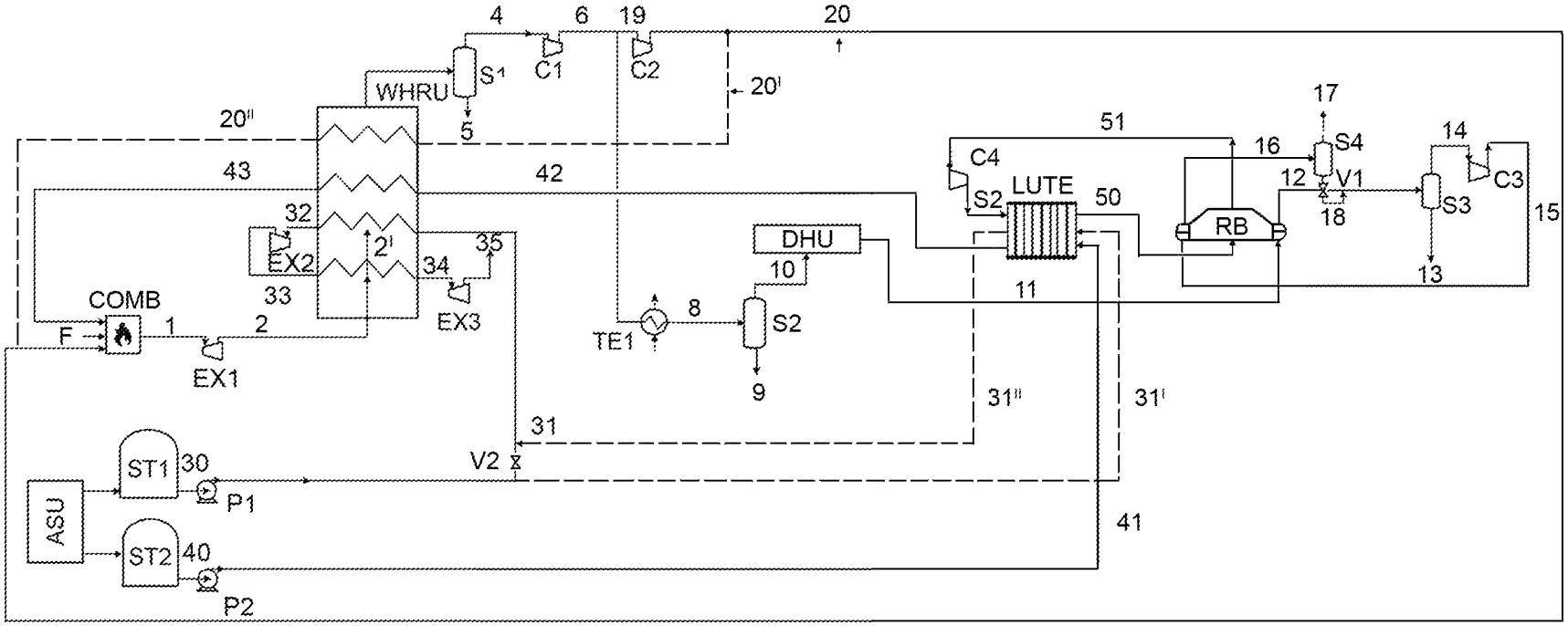
FIG. 5B shows a modification of this variant.

The diagram in FIG. 5B is similar to that in FIG. 5A but comprises some modifications according to the alternatives described above; in particular, a portion of the liquid air is employed in addition to liquid oxygen if it is necessary to condense a large amount of $CO_2$, possibly accompanying the fuel, as is typical of some gas fields which are difficult to exploit.

The process conducted according to such configurations was advantageously conceived for the use of standard turbines, thus allowing a maximum inlet temperature of about 1,200° C.

As for the diagram in FIG. 6, this includes the use of oxygen-depleted air as the first working fluid, while the $CO_2$ liquefaction unit comprises an exchanger, in which a direct exchange with the liquid oxygen is conducted.

The diagram in FIG. 7A includes the use of oxygen-depleted air as the first working fluid, while the $CO_2$ liquefaction unit comprises a condenser, in which an indirect exchange with the second working fluid mediated by a refrigerant vector fluid is conducted.

The diagram in FIG. 7B is similar to that in FIG. 7A but comprises some modifications according to the alternatives described above; in particular, a portion of the liquid air is employed in addition to liquid oxygen if it is necessary to condense a large amount of $CO_2$, possibly accompanying the fuel, as is typical of some gas fields which are difficult to exploit.

From the description provided above, the advantages offered by the present invention will be apparent to a person skilled in the art.

From the plant engineering point of view, the described process allows eliminating the Rankine cycle for the recovery of heat from the exhaust turbine fumes and simplifying the plant, especially if the Rankine cycle uses water as an engine fluid.

Furthermore, the process is particularly suitable for offshore applications.

According to the integration of an oxy-combustion plant for energy production with a LAES storage, the present invention allows creating a synergy between a system for storing electrical energy, which is in excess of demand at certain times, and a system for producing electrical energy to be fed into the network during periods of increased demand.

In particular, the synergy is demonstrated in the higher efficiency than the efficiency offered by the individual technologies.

One of the most obvious advantages is the possibility of leveling and stabilizing the network, i.e., making its production continuous and aligning the supply with the demand for electrical energy.

By virtue of the stabilizing effect of the electrical power network, the system of the invention promotes further use of renewable energy.

Therefore, this combination allows overcoming the known problems in the industry, while ensuring zero environmental impact.

More in particular, the present invention allows producing and storing liquid air (or nitrogen or oxygen-depleted air) using electrical energy in excess of the demand; this can be useful, for example, at night, when electrical consumption decreases.

The integration of oxy-combustion and liquid air energy storage (LAES) technologies results in an energy production battery which combines the merits of both technologies and uses the resulting synergies to eliminate/improve important technical aspects of both.

With respect to fuel use, compared to traditional oxy-combustion layouts, the process described increases the life of non-renewable resources, extending the time available for the energy transition.

What is claimed is:

1. A process for producing power and liquefying a gas, the process comprising:

1) producing, in a combustor, by combusting a fuel at a pressure higher than atmospheric pressure and in an atmosphere of $CO_2$ and $O_2$, an exhaust gas comprising water vapor and $CO_2$,
2) expanding said exhaust gas in a first turbine generating power production, thus obtaining an expanded exhaust gas,
3) cooling the expanded exhaust gas in a waste heat recovery unit (WHRU), inside the WHRU, by virtue of heat exchange with a first working fluid is liquid air or oxygen-depleted air which is heated, thus obtaining a partial condensation flow of the water vapor,
4) separating, in a first separator, the condensed water vapor and a partially dehydrated exhaust gas,
5) compressing said partially dehydrated exhaust gas in a first compressor, thus obtaining a compressed exhaust gas,
6) separating a first portion of said compressed exhaust gas and further compressing it in a second compressor, thus obtaining a flow of further compressed exhaust gas,
7) returning the flow of further compressed exhaust gas to said combustor,
8) cooling a second portion of said compressed exhaust gas in a first exchanger, thus obtaining a second cooled portion,
9) separating, in a second separator, a flow of condensed water vapor and a further dehydrated exhaust gas,
10) further dehydrating said further dehydrated exhaust gas, thus obtaining an even further dehydrated exhaust gas, and
11) liquefying the $CO_2$ contained in said even further dehydrated exhaust gas which comprises a heat exchange between said even further dehydrated exhaust gas and a flow of a second working fluid in a liquefaction unit, thus obtaining a flow mainly composed of liquid $CO_2$ and a flow of the second partially heated working fluid, wherein said first working fluid is produced by air liquefaction or air separation, wherein said second working fluid is liquid oxygen optionally produced by air liquefaction or air separation, and wherein the flow of the second partially heated working fluid is used in step 3) in a further step of heat exchange with the expanded exhaust gas, thus obtaining a further heated flow of said second working fluid.

2. The process of claim 1, wherein, during step 2), the power generated is converted into electrical energy and/or mechanical energy.

3. The process of claim 1, wherein, during step 3), the cooling is obtained by one or a plurality of successive heat exchange steps with said first working fluid.

4. The process of claim 3, wherein, after each heat exchange step, said first working fluid is expanded during a respective expansion step.

5. The process of claim 3, wherein each of the heat exchange steps occurs with said first working fluid in unexpanded form or, for the plurality of successive heating steps, in a respective expanded form after each successive heating steps of the plurality of successive heating steps.

6. The process of claim 1, wherein step 3) comprises:

a first heat exchange 3a), between said expanded exhaust gas and a heated, expanded flow of said first working fluid, thus obtaining a partially cooled expanded exhaust gas and a first further heated and further expanded working fluid, and a second heat exchange 3b) between said partially cooled expanded exhaust gas and a not-expanded flow of said first working fluid.

7. The process of claim 1, wherein said heat exchange of step 11) is a direct heat exchange.

8. The process of claim 1, wherein said heat exchange of step 11) is an indirect heat exchange by a refrigerant vector fluid.

9. The process of claim 1, wherein said further heated flow of said second working fluid is sent to the combustor of step 1).

10. The process of claim 1, wherein step 8) comprises heat exchange between said second portion of the compressed exhaust gas and a flow of a third working fluid, thus obtaining a heated flow of said third working fluid.

11. The process of claim 10, wherein, after step 8), the heated flow of the third working fluid is employed in a further cooling step of the expanded exhaust gas, thus obtaining a further heated flow of the third working fluid, which is then expanded in a fourth expander, thus obtaining a heated and expanded flow of the third working fluid.

12. The process of claim 11, wherein said heated and expanded flow of the third working fluid is circulated at the bottom of a first distillation column.

13. The process of claim 12, wherein a portion of the flow of the third working fluid is recirculated to the first distillation column.

14. The process of claim 10, wherein said third working fluid is liquid air, optionally produced by air liquefaction or air separation.

15. The process of claim 12, wherein a bottom flow, circulated to a second distillation column, and a head flow, sent to a reboiler of said second distillation column, are obtained from said first distillation column.

16. The process of claim 15, wherein from a head of said second distillation column there is obtained a head flow, which is subjected to a heat exchange in a fourth heat exchanger, and a bottom flow, sent to said reboiler.

17. The process of claim 16, wherein a liquid oxygen flow is obtained from the bottom of said reboiler, and a partially condensed flow is obtained from the head, which is sent to a fifth separator S5.

18. The process of claim 17, wherein a gaseous phase is separated from a head of said fifth separator, which is then compressed in a fifth compressor, thus obtaining a compressed head flow, and, from the bottom of said fifth separator, there are obtained a first portion of separated liquid, which is pumped, thus obtaining a pumped flow which is sent to a head of the first distillation column, and a second portion of the separated liquid which is sent to the second distillation column, after being cooled in the fourth exchanger by heat exchange with the head flow exiting the second distillation column and laminated by a valve.

19. The process of claim 16, wherein a flow is obtained from heat exchange in the fourth exchanger, which is then compressed in a sixth compressor, thus obtaining a high pressure flow.

20. The process of claim 19, wherein said high pressure flow and said compressed head flow are combined, thus obtaining a not-expanded flow of the first working fluid.

* * * * *